United States Patent [19]

Quadling et al.

[11] 4,367,250

[45] Jan. 4, 1983

[54] LEAD LIGHTS

[76] Inventors: Darrell F. Quadling, 25a Moore St., Birkenhead, Auckland; Ross M. Bailey, 9 Valerie Crescent, Okura, both of New Zealand

[21] Appl. No.: 253,910

[22] Filed: Apr. 14, 1981

[30] Foreign Application Priority Data

Apr. 17, 1980 [NZ] New Zealand ..... 193459

[51] Int. Cl.[3] ..... B44F 1/06

[52] U.S. Cl. ..... 428/38; 156/63; 428/415; 428/698

[58] Field of Search ..... 260/29.2 EP; 428/38, 428/413, 13, 698, 415; 156/63

[56] References Cited

U.S. PATENT DOCUMENTS

| | | | |
|---|---|---|---|
| 667,444 | 2/1901 | Kyle | 428/38 |
| 914,734 | 3/1909 | Kyle | 428/38 X |
| 1,524,998 | 2/1925 | Russell | 428/38 X |
| 3,183,140 | 5/1965 | Gibson, Jr. | 428/38 |
| 3,420,728 | 1/1969 | Haverstock | 428/38 |
| 3,713,958 | 1/1973 | McCracken | 428/38 |
| 3,815,263 | 6/1974 | Oberwager | 428/38 X |
| 3,855,157 | 12/1974 | Zondler et al. | 260/29.2 EP X |
| 3,900,641 | 8/1975 | Woodman et al. | 428/38 |
| 3,931,425 | 1/1976 | Kuroda | 428/38 |
| 4,009,309 | 2/1977 | Holt | 428/38 |
| 4,127,689 | 11/1978 | Holt | 428/38 |
| 4,168,254 | 9/1979 | Fell | 428/413 X |
| 4,194,669 | 3/1980 | Bromberg | 428/38 X |
| 4,228,207 | 10/1980 | Porte et al. | 428/80 |
| 4,248,752 | 2/1981 | Myles | 260/29.2 EP X |

*Primary Examiner*—Henry F. Epstein

*Attorney, Agent, or Firm*—Zarley, McKee, Thomte, Voorhees & Sease

[57] ABSTRACT

A method of forming a simulated lead light involves the application of opaque cames to the surface of a transparent or translucent sheet of material, in which the opaque cames are built up successive applications of adhesive and opaque particulate material, such as silicon carbide. The adhesive can be screen printed onto the carrier surface and the particulate material can be dusted onto the printed adhesive. The application of adhesive and particulate material can be repeated until a raised came of desired thickness is built up on the carrier surface to simulate a lead came. The method can also be used in conjunction with the screen printing of colors onto the carrier surface to simulate stained glass separated by simulated lead cames.

8 Claims, No Drawings

LEAD LIGHTS

IMPROVEMENTS IN OR RELATING TO LEAD LIGHTS

This invention relates to a method of manufacturing simulated lead lights, including simulated stained glass windows.

Lead lights are used as windows, in decorative doors, in glass partitions, as back lit panels, and as part of decorative articles, e.g. in glass lamp shades. Hitherto, the manufacture of lead lights has required the placement of small panes of glass between soft lead cames, which lead cames provide the bold outline for the lead light. If the small pieces of glass are stained, they can be put together to create a stained glass window. It will be appreciated that this age old practice is both expensive and time consuming and suffers from various disadvantages apart from the expense, including; (a) the difficulty of manufacturing and installing large lead lights as the resulting structure is wobbly, (b) conventional lead lights have a tendency to leak between the cames and the pieces of glass, (c) the completed lead light is heavy, (d) completed lead lights have a tendency to bow or distort with time, and (e) it is difficult to use a conventional lead light in conjunction with aluminium framing, as the lead cames react with the aluminum.

Many attempts have been made to produce simulated lead lights and/or stained glass windows, and the following U.S. patent specifications illustrate the many different approaches that have been made to solving these problems. U.S. Pat. No. 914,734 to Kyle, issued Mar. 9, 1909. U.S. Pat. No. 3,183,140 to Gibson, issued May 11, 1965. U.S. Pat. No. 3,420,728 to Havistock, issued Jan. 7, 1969. U.S. Pat. No. 3,713,958 to McCracken, issued Jan. 30, 1973. U.S. Pat. No. 3,815,263 to Oberwagner, issued June 11, 1974. U.S. Pat. No. 3,900,641 to Woodman, issued Aug. 19, 1975. U.S. Pat. No. 3,931,425 to Kuroda, issued Jan. 6, 1976. U.S. Pat. No. 4,009,309 to Holt, issued Feb. 22, 1977. U.S. Pat. No. 4,127,689 to Holt, issued Nov. 28, 1978. U.S. Pat. No. 4,194,669 to Bromberg, issued Mar. 25, 1980.

None of these attempts have proved to be commercially satisfactory. Some of them involved the fixing of lead strips to the outside of a glass sheet (e.g. Bromberg U.S. Pat. No. 4,194,669), whilst others involved the application of a paint (Woodman, U.S. Pat. No. 3,900,641), a paste, (Havistock U.S. Pat. No. 3,420,728), or an ink, (Kuroda U.S. Pat. No. 3,931,425).

The invention as claimed is intended to provide an improved method of forming a simulated lead light. It overcomes the disadvantages of the prior art proposals by building up the simulated lead cames by applying an adhesive material to the surface of a carrier sheet, e.g. a sheet of glass, and applying an opaque particulate material such as silicon carbide to the adhesive lines or strips, removing excess particulate material, and repeating the layers of adhesive and particulate material until a satisfactory simulated lead came is created.

The invention provides the following advantages:

(a) the ability to create a simulated lead came without the need to apply a thick viscos paste, paint or ink, as the adhesive and particulate material are applied separately;

(b) the invention allows the adhesive material to be applied to the carrier sheet by screen printing to ensure accurate registry of successive layers and/or registry between canes on each side of the carrier sheet;

(c) as the adhesive and particulate material are applied separately, complicated curves and fine details can be created which would not be possible with conventional lead lights;

(d) large sheets of glass can be provided with simulated lead canes on the surface thereof, and the sheets can then be cut to size as and when required.

Examples of how the invention can be put into practice are described below with reference to the following examples.

EXAMPLE 1

A one-sided simulated lead light is formed in the following manner. A production line for the production of such simulated lead lights, involves a washing station, a printing station, a dusting station, and a stacking area.

Sheets of glass are first washed with a water wash and allowed to dry. The dry sheets are then conveyed sequentially to a printing station. Conveniently, the sheets are moved on a suitable conveyor, e.g. in the horizontal mode on an air flotation conveyor.

As each sheet reaches the printing station, it is positioned in place according to the appropriate registers, and adhesive lines or strips are applied to the surface of the sheet by screen printing.

The adhesive material preferably consists of an epoxy based ink capable of readily passing through a coarse meshed screen. A preferred screen is of 25 T mesh size. The screen is provided with a suitable stencil in the usual screen printing manner to enable an appropriate pattern of lines or strips of adhesive to be applied through the screen onto the glass surface.

The screen is removed and the adhesive printed sheet is conveyed to a dusting station. At the dusting station, a dry particulate material, such as silicon carbide is dusted onto the entire sheet, so that it will adhere to the printed adhesive lines or strips. Surplus particulate material is removed from the sheet, by lifting the sheet into a vertical position and brushing down the surface. The sheets are then stored until the adhesive has set. These sheets are conveniently stored in vertical racks. The drying time will depend upon the adhesive composition used. A suggested drying period is 24 hours.

The dusting station is preferably remote from both the washer and the printing station to avoid contamination by the particulate material. Surplus particulate material is preferably removed by suction cleaners and filters to prevent dust build-up in the air.

The dry sheets are then returned to the printing station, and subsequent layers of adhesive and particulate material are applied to the sheets until a sufficient thickness of material has been applied to the surface to simulate a lead came, in accordance with the end user's requirements.

A thickness of two to three millimeters can be built up utilizing several layers, for example, using a first layer of relatively coarse grit size, e.g. in the range 120–180 grit size and subsequent layers can be of finer grit size, e.g. in the range of 320–600 grit size of silicon carbide. If desired, a matt coating can be applied as a finish layer to the lead came. Such a matt coating may consist of the epoxy based ink, together with a dark grey additive. Other colour additives can be utilized depending upon the effect required by the end user.

The epoxy based adhesive, is preferably formulated for screen printing. A suitable epoxy based adhesive ink is applied by Croda Polymers N.Z. Limited, of 34 Ben Lomond Crescent, Pakuranga, Auckland, New Zealand, under the trade mark CATALINK. This company also supplies thick screen printing inks under the trade mark CATALINK, suitable for colouring the surface of the glass.

EXAMPLE 2

A two-sided simulated lead light is produced by building up simulated lead cames on one side of a carrier surface, e.g. a plain glass sheet, as outlined in Example 1, utilizing an initial coating of 120 grit size silicon carbide, dusted on to screen printed strips of adhesive, followed by the removal of excess particulate material by brushing and dusting off the surface, allowing the adhesive layer to dry, and then applying subsequent layers of adhesive to which a finer grade of silicon carbide is applied, e.g. 400 grit size, repeating the application of the 400 grit size, and applying a final matt coating as noted above.

When the simulated cames have been built up on the first surface of the glass, the glass sheet is turned over, and the process repeated. In printing on to the reverse face of the glass sheet, the screen is also inverted to ensure that the printing is in register with the first set of simulated lead canes.

EXAMPLE 3

Simulated stained glass is achieved by screen printing the colours in combination with the build up of the simulated lead canes as described in Example 1 or Example 2.

The carrier's surface for this is preferably a rough textured glass, e.g. Cathedral glass to enhance the coloured effect.

The coloured layers are preferably screen printed onto the glass using a finer mesh than is utilized for the adhesive. A suitable mesh for the coloured areas is 120 T mesh size, although other mesh sizes can be utilised. The coloured areas are preferably applied to the glass prior to the application of the adhesive lines or strips. Colours may be applied to one or both sides of the glass surface, depending upon the end use for the simulated stained glass.

VARIATIONS

The above examples refer to silicone carbide as the particulate material. This has proved to be satisfactory although it will be appreciated that other opaque particulate materials can be utilized, one such is black sand or New Zealand iron sand.

The preferred adhesive material is an epoxy based screen printing ink, although it will be appreciated that other adhesive materials can be utilized. The nature, setting time and viscosity of the adhesive material will depend upon the method of application.

Although the invention lends itself particularly to the use of screen printing in the application of the adhesive lines or strips, it will be appreciated that other means of applying the adhesive may be utilized, e.g. by brush painting, spraying or by other printing processes.

It will also be noted that different effects can be achieved by utilizing different grades of particulate material in building up the simulated lead canes on one or both sides of the carrier sheet. The invention is particularly suitable for creating a simulated lead light effect on glass sheets, although other transparent or translucent materials can be utilised, e.g. plastics sheets. Indeed, the method of this invention can be used to create complex curves and fine details which would otherwise be impossible to achieve with conventional lead lights.

We claim:

1. A method of forming a simulated lead light in which opaque cames are applied to a surface of a transparent or translucent carrier material, characterised in that: the cames are built up by applying an adhesive material to the carrier surface in lines or strips corresponding to the position of desired cames, applying on opaque particulate material to said adhesive lines or strips, removing unadhered particulate material, and repeating the steps of applying adhesive material and particulate material to build up raised cames on the carrier surface.

2. A method as claimed in claim 1, characterised in that the particulate material consists of silicon carbide.

3. A method as claimed in claim 2, characterised in that the adhesive is an epoxy based ink which is screen printed onto the carrier surface.

4. A method as claimed in claim 3, characterised in that said particulate material is applied initially as a coarse grit in the range of 120–180 grit size, and subsequent layers of particulate material are of finer grit size.

5. A method as claimed in claim 4, characterised in that the subsequent layers of particulate material are chosen from the range of 320–600 grit size.

6. A method as claimed in claim 5, characterised in that the cames are applied to both surfaces of a carrier sheet, the cames on each surface being in register one with the other.

7. A method as claimed in claim 5, characterised in that one or both surfaces of the carrier material is or are coloured by screen printing.

8. A simulated lead light manufactured in accordance with the method of claim 1.

* * * * *